US005791241A

United States Patent [19]

Levy

[11] Patent Number: 5,791,241

[45] Date of Patent: Aug. 11, 1998

[54] PRESS WITH PNEUMATICALLY OPERATED LINKAGE MECHANISM WITH ROLLERS FOR PROVIDING FOUR POINT ROLLER CONTACT

[75] Inventor: Roger Levy, Bloomfield Hills, Mich.

[73] Assignee: Tishken Products, Inc., Detroit, Mich.

[21] Appl. No.: 703,210

[22] Filed: Aug. 26, 1996

[51] Int. Cl.[6] ..... B30B 1/08

[52] U.S. Cl. ..... 100/271; 72/453.03; 100/285

[58] Field of Search ..... 100/270, 271, 100/272, 280, 281, 283, 285, 291; 72/452.2, 452.8, 453.03; 83/627, 639.1

[56] References Cited

U.S. PATENT DOCUMENTS

| | | | |
|---|---|---|---|
| 153,289 | 7/1874 | Walker | 100/271 |
| 178,174 | 5/1876 | Martin | 100/285 |
| 402,636 | 5/1889 | Webb | 100/272 |
| 553,827 | 2/1896 | Block | 100/285 |
| 2,105,053 | 1/1938 | Patrick | 100/271 |
| 2,135,299 | 11/1938 | Benander | 100/271 |
| 2,204,413 | 6/1940 | Hubbert | 100/271 |
| 3,196,700 | 7/1965 | Gron | 100/285 |
| 3,908,541 | 9/1975 | Meidell | 100/271 |
| 4,579,031 | 4/1986 | Lash et al. . | |
| 4,685,367 | 8/1987 | Lash et al. . | |
| 5,062,357 | 11/1991 | Senior et al. . | |
| 5,182,985 | 2/1993 | Gutowski . | |

*Primary Examiner*—Stephen F. Gerrity
*Attorney, Agent, or Firm*—Dykema Gossett PLLC

[57] ABSTRACT

A single-cylinder pneumatic press has a ram member spaced apart from lower head die, and a work area being defined therebetween. The cylinder and the piston rod enable reciprocating movement of the ram member relative to the lower head die. A return spring biases the ram member away from the surface. A linkage mechanism enables cooperative engagement between the piston rod and the ram member. The linkage mechanism provides rolling contact with the ram member along four distinct linear locations. The linkage mechanism includes four pivot brackets, enabling pivotal rotation of the bell cranks relative thereto, and a lever pin pivotably connecting the bell cranks together. Sandwiched between the bell cranks are two cam followers, which are driven upwardly and downwardly by the piston rod, the bell cranks each including a pair of rollers which engage with the ram member and provide "four point" contact therewith.

10 Claims, 5 Drawing Sheets

PRESS WITH PNEUMATICALLY OPERATED LINKAGE MECHANISM WITH ROLLERS FOR PROVIDING FOUR POINT ROLLER CONTACT

BACKGROUND OF THE INVENTION

The present invention relates to a pneumatic press, and more specifically, to a pneumatic press actuated by a cylinder and piston rod whereby a linkage mechanism applies force to a ram member through a plurality of roller members.

Pneumatic presses are widely used in numerous applications. Pressure is defined as force acting per unit area. Presses conventionally include a ram member mounted on a plurality of upright guide posts, a ram plate sliding in a horizontal plane relative to the guide posts and a stationary bed.

U.S. Pat. No. 4,579,031 (Lash et al.) discloses a two-cycle pneumatic cut-off press with an improved power mechanism for reciprocally operating a ram plate relative to a bed plate. The press includes a single bell crank. The die set area is between the ram plate and the bed plate, and includes opposed upper and lower track members for mounting upper and lower die sets, respectively.

U.S. Pat. No. 4,685,367 (Lash et al.) discloses another two-cycle pneumatic cut-off press with an improved power mechanism for reciprocally operating a ram plate relative to a bed plate. An upper movable die set is cooperatively engaged with the ram plate, and a lower stationary die set is secured to the bed plate. The press has two bell cranks, and introduces roller contact between the top plate and the linkage mechanism, and roller contact between the linkage mechanism and the ram plate.

U.S. Pat. No. 5,062,357 (Senior et al.) discloses a pneumatic press having a single cylinder and piston, and the disclosure of which is incorporated herein by reference, as illustrative of the general operation of such a press.

The use of rollers have been shown to eliminate lateral forces on the guide posts, and reduce the normal wear on internal press surfaces. However, the use of a single roller on a surface provides linear roller contact with the surface, and while the position of the linear contact changes as the position of the linkage mechanism varies, such presses are somewhat unstable and tend to wobble during operation.

What is needed is a lever-type pneumatic press, that takes advantage of roller contact on the ram member, while minimizing the above disadvantages.

A low profile pneumatic press is needed that reduces noise, vibration, and wear caused by larger masses moving longer distances.

While roller contact is a major advance in improving press durability, a new type of roller contact is needed that will provide a uniform force across the surface of the ram member, and enable stable vertical movement of the ram member during the power stroke.

SUMMARY OF THE INVENTION

The press generally comprises a movable ram member or upper die head spaced vertically above a stationary lower die head secured relative to the base. A die set area is defined by and between the undersurface of the ram member or movable upper die head and the upper surface of the stationary lower die head.

A single cylinder is mounted upon a cylinder head or top plate. The cylinder includes a piston rod. The cylinder head includes a bore therein enabling the piston rod to pass therethrough and engages a linkage mechanism. The single cylinder and the piston rod enable reciprocating movement of the ram member relative to the lower die head.

The linkage mechanism is mounted upon the ram member or movable upper die head, and enables cooperative engagement between the piston and the ram member.

In the preferred embodiment, the linkage mechanism includes a pair of pivot brackets, each bracket having a pair of bracket elements which are mounted symmetrically about a corner of the cylinder head. Two bell cranks or levers are pivotally connected between opposing pivot brackets. The inner ends of the bell cranks are provided with cam followers which are spaced apart along a traverse axis. The cam followers are cooperatively engageable with the piston rod.

The linkage mechanism enables cooperative linear engagement between the piston rod along four distinct locations of the upper surface of the ram member. Each of the bell cranks cooperatively engages a pair of rollers for rolling engagement with the upper surface of the ram member, enabling "four-point" contact.

The ram member or movable upper die head is urged toward stationary the lower die head when the piston rod is extended, and the ram member is withdrawn when the piston rod is retracted. The press also preferably includes spring return means for biasing the ram member away from the lower die head.

The mechanical advantage of the linkage mechanism may be adjusted by varying the size of the lever arms of the bell cranks.

For a more complete understanding of the pneumatic press of the present invention, reference is made to the following detailed description and accompanying drawings in which the presently preferred embodiment of the invention is shown by way of example. As the invention may be embodied in many forms without departing from spirit of essential characteristics thereof, it is expressly understood that the drawings are for purposes of illustration and description only, and are not intended as a definition of the limits of the invention. Throughout the description, like reference numbers refer to the same component throughout the several views.

DETAILED DESCRIPTION OF THE PREFERRED EMBODIMENT

Figure 1:
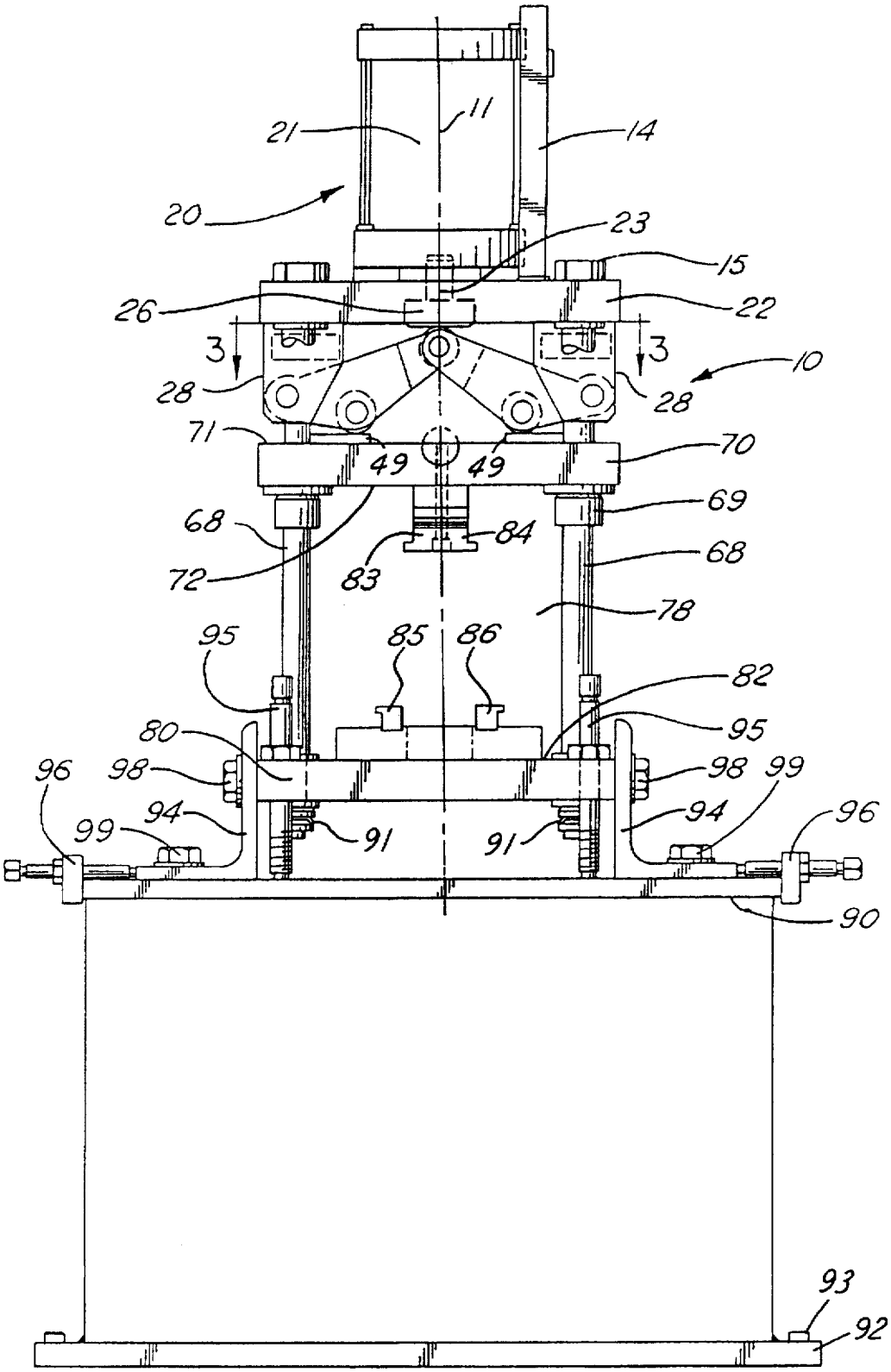
FIG. 1 is a front elevational view of the preferred embodiment embodying the pneumatic press of the present invention, the piston rod and linkage mechanism being in the retracted position.
Figure 2:
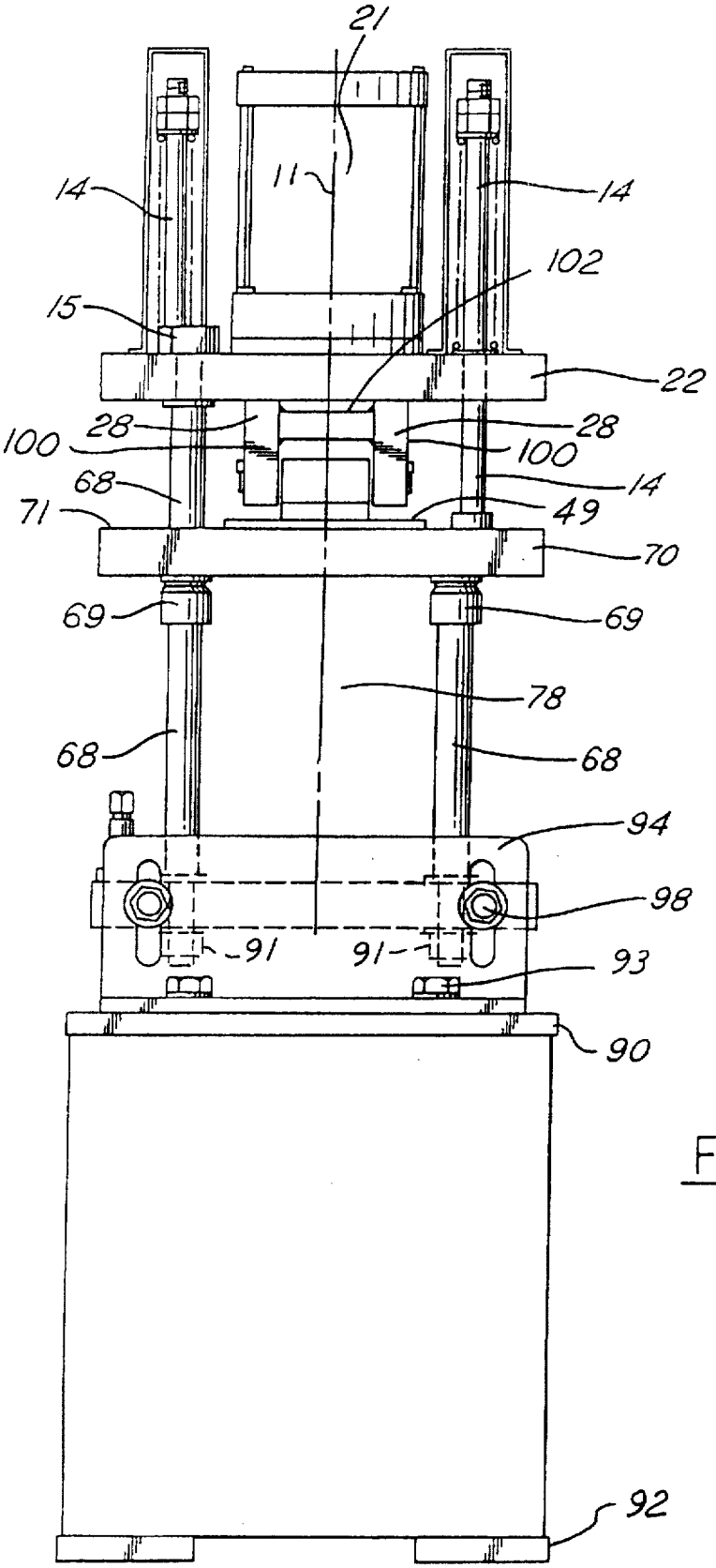
FIG. 2 is a side elevational view of the pneumatic press of FIG. 1, with the piston rod and the linkage mechanism in the retracted position.

Turning now to the drawings, FIGS. 1 and 2 disclose front and side elevational views, respectively, of the preferred embodiment of the pneumatic press [10] constructed according to the principles of the present invention.

The press [10] has a vertically extending longitudinal axis 11 and generally includes a pneumatic cylinder assembly [20], a linkage mechanism [30], a ram member or movable upper die head [70] spaced vertically above a stationary lower die head [80] disposed on the press base [90]. A die set area [78] is defined between the undersurface [72] of the ram member [70] and the upper surface [82] of the lower die head [80].

The pneumatic cylinder assembly [20] includes a single, upright, high-pressure, air cylinder [21] mounted upon a stationary cylinder top plate or head [22] of the press [10]. The cylinder [21] has a reciprocating cylinder rod or piston [23] and an axially connected piston or cylinder rod extension [26] for upward and downward engagement. The cylinder head [22] includes a bore [25] that is centrally disposed therewithin and is cylindrical in shape, enabling the cylinder rod 23 and the cylinder or piston rod extension [26] to pass therethrough.

Figure 3:
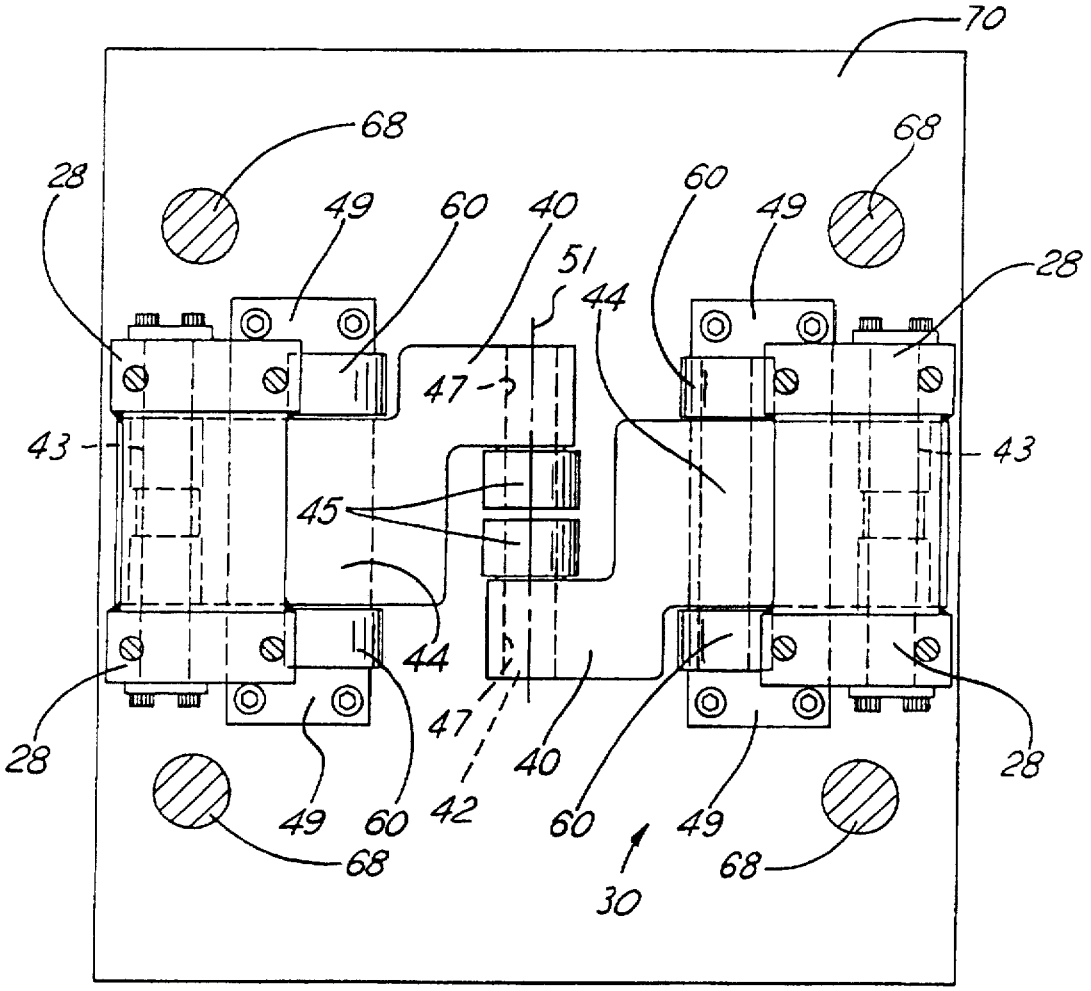
FIG. 3 is a cross-sectional view of the linkage mechanism of the pneumatic press of the present invention in the retracted position taken along lines 3—3 of FIG. 1.

The cylinder head [22] also includes a pair of pivot brackets [28] for mounting the linkage mechanism [30] therebetween. Each bracket has a pair of bracket members 100 connected by welding to a cross member 102 as shown in FIG. 2. The cylinder [21] and the piston rod extension [26] enable reciprocating movement of the ram member [70] relative to the stationary lower die head [80]. The pivot brackets [28] are spaced-apart opposing each other as shown in FIGS. 2 and 3. Each bracket 28 is mounted symmetrically onto the cylinder head or top plate [22], and extends downwardly therefrom into the space between the top plate 22 and the movable upper die head or ram member 70. Each pair of pivot bracket members 100 include opposing apertures [29] for mounting and retaining a bracket pin [43] therewithin. Each bracket pin [43] enables pivotal engagement with the novel linkage mechanism [30]. The two bracket pins [43] oppose each other when mounted relative to each pair of pivot brackets [28].

The pneumatic cylinder [21] also includes spring return means [14] for biasing the ram member or movable upper die head [70] away from the lower die head [80] during reciprocating movement of the ram member [70] away from the lower die head [80].

Figure 5:
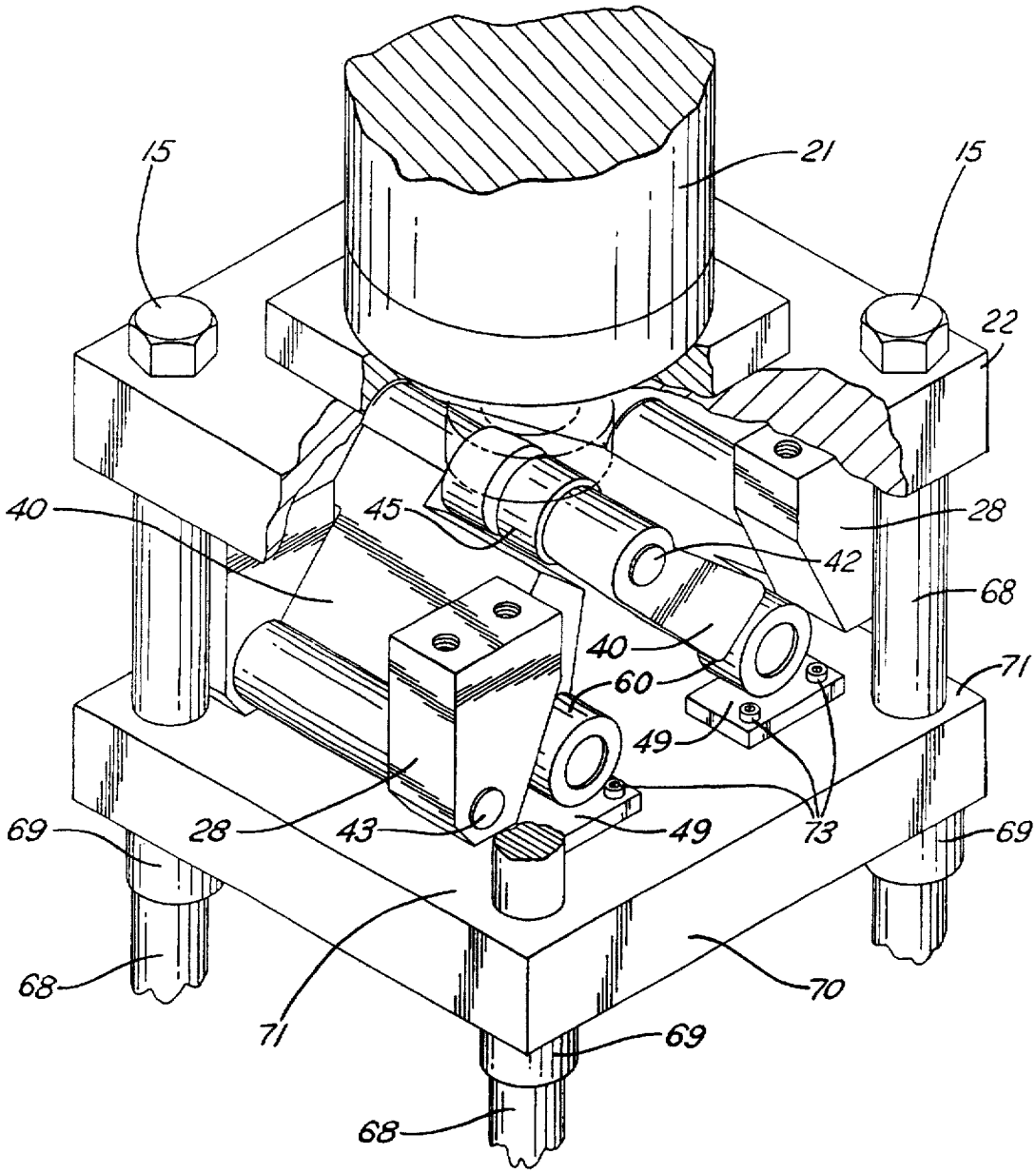
FIG. 5 is an enlarged isometric view of the linkage mechanism of the pneumatic press of FIG. 1, with the piston rod in the retracted position.

The linkage mechanism [30] is mounted between the pivot brackets [28], and enables cooperative rolling engagement between the piston [23] and four distinct locations on the upper surface [71] of the ram member [70]. The linkage mechanism [30] includes two levers or bell cranks [40], cam followers [45]with mounting pins [42] , two roller pins [44], and four cylindrical rollers [60]. FIG. 5 discloses an isometric perspective of the linkage mechanism [30], with the outermost bell crank or lever [40] cutaway.

As used herein, the top, front, and end planes relative to linkage mechanism [30] are normal to each other and are defined as follows:

- a front plane is normal to the axis of mounting pin [42] of the cam followers 45, the axes of the bracket pin [43], and the axes of the roller pin (FIG. 1 is the front view of the linkage mechanism [30]);
- an end plane is parallel to the plane defined by the intersection of the longitudinal axis of the upward-downward motion of the piston rod [26] with the intersection of the axis of the mounting pin [42] (FIG. 2 is the end view of the linkage mechanism [30]); and
- a top plane is parallel to the roller surface contact area on the ram member [70] (FIG. 3 is the top view of the linkage mechanism [30]).

As viewed from the front plane, the levers or bell cranks [40] have a generally triangular shape with rounded angles. The two smallest angles, the lever pin angle [32] and the bracket pin angle [33] are thickened and extend around the adjoining legs of the triangular shape. The front and rear surfaces of the levers or bell cranks [40] are parallel to the front plane.

A portion of each bell crank or lever [40] nearest the upper surface thereof is truncated to enable clearance for the centrally disposed cam followers [45]. The cam truncation [36] is formed by the intersection of one plane parallel to the nearest tangential surface of the cam follower [45] and a second plane parallel to the front plane.

A portion of each bell crank [40] nearest the surface that engages the mounting pin [42] is truncated to enable clearance for a pivot bracket [28]. The bracket truncation [37] is formed by the intersection of one plane parallel to the front surface, and a second plane parallel to and aligned with the nearest tangential surface of the cam follower [45] of the cam truncation [36].

Figure 4A:
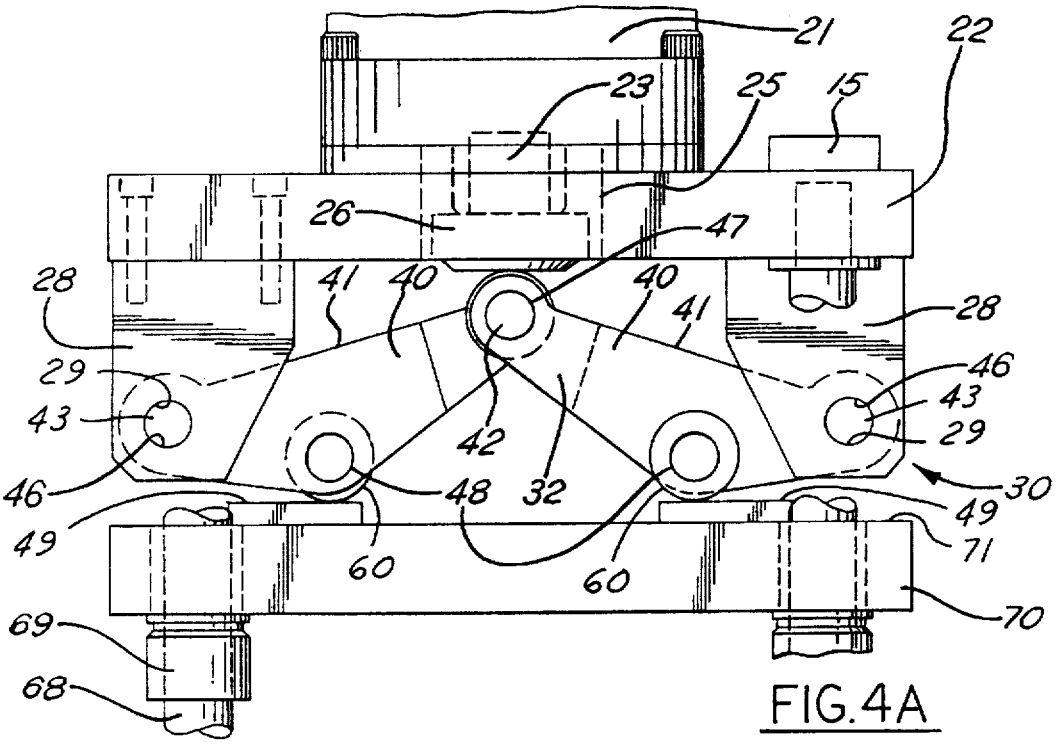
FIG. 4A is an enlarged front elevational view of the linkage mechanism of the pneumatic press of FIG. 1, with the piston rod in the retracted position.
Figure 4B:
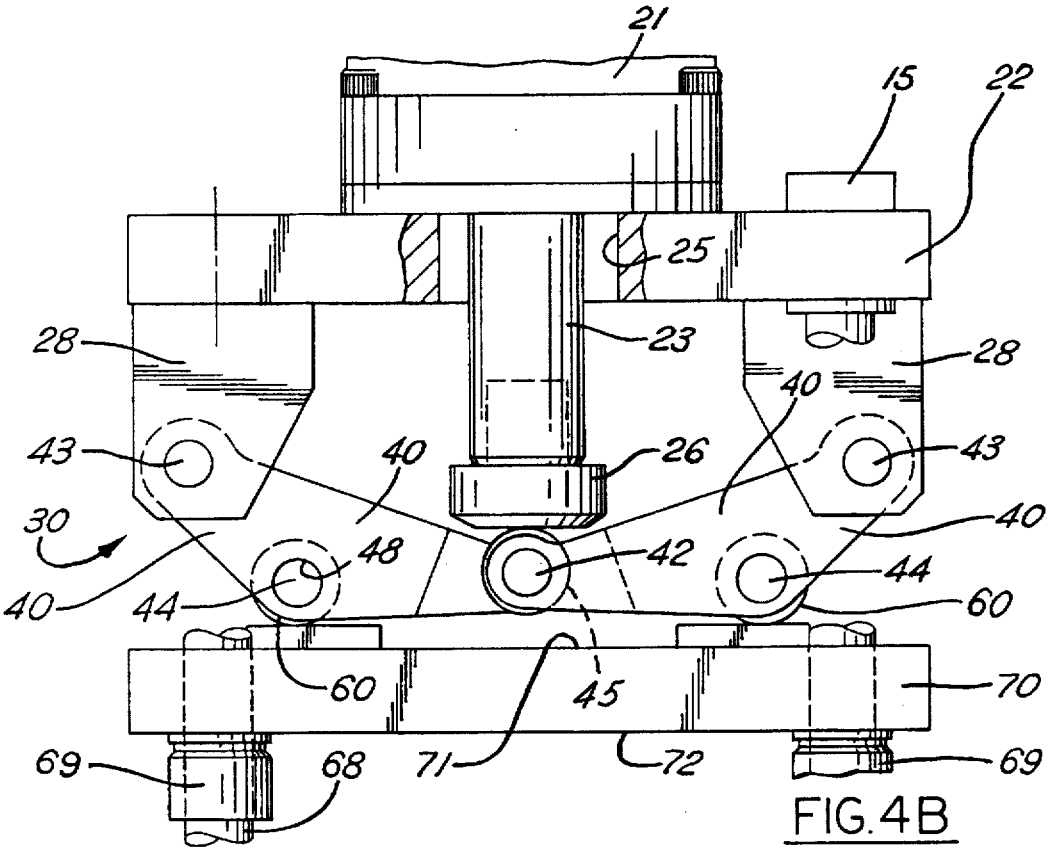
FIG. 4B is an enlarged front elevational view of the linkage mechanism of the pneumatic press of FIG. 1, with the piston rod in the extended position.

The two identical bell cranks or levers [40] oppose each other as mounted on the bracket pins [43] of the pivot brackets [28] (see FIGS. 4A or 4B). Each leg of the lever or bell crank [40] is of different length. Each bell crank [40] includes a cylindrically-shaped angular bore disposed near the intersection of each pair of legs of the triangular-shaped bell crank [40] enabling pivotal connection of the linkage mechanism [30];

- a bracket angular bore [46] enabling engagement of the bell crank [40] with the bracket pins [43] and the pivot bracket [28],
- a mounting angular bore [47] enabling engagement with the lever pin [42] of each cam follower 45 and the other bell crank [40], and
- a roller angular bore [48] enabling engagement with the roller pins [44] and the rollers [60].

The cam follower mounting pin [42] is inserted into the laterally spaced apart bores [47 ] provided in the outer ends of the levers 40 as shown in FIG. 3, [47]. The lever pin angle [32] represents the smallest angle of each bell crank [40]. The cam follower mounting pins [42] join the two bell cranks [40] together. Sandwiched between the lever angular bores [47] of the two bell cranks [40] are the pair of cylindrical-shaped cam followers [45] for cooperative engagement with the reciprocating piston rod [26] as the piston rod [26] moves upward and downward.

The lever leg [41] is the longest of the three legs of the bell crank [40]. The lever leg [41] may be lengthened or shortened to vary the mechanical advantage of each bell crank [40]. Since the bell cranks [40] are identical to each other, the mechanical advantages of the two bell cranks [40] are the same. The roller angular bore [48] opposes the lever leg [41], and the bracket angular bore [46] is nearest the roller angular bore [48].

Each bell crank [40] pivots about its respective bracket pin [43], and the bracket angular bore [46] is essentially stationary relative to the cylinder head [22] during the power stroke. The relative distance between the lever angular bore [47] and the piston rod [26] is unchanged during the power stroke. When the piston rod [26] is in the retracted position as shown in FIG. 4A, the ram member [70] is raised from the lower die head [80], and when the piston rod [26] is in the extended position as shown in FIG. 4B, the ram member [70] is in its lowermost position relative to the lower die head [80]. As the power stroke begins, the piston rod [26] moves downwardly relative to the cylinder head [22], repositioning the cam followers and their mounting pins [42]

downwardly, and repositioning the respective rollers [60] both in an outward direction and in a downward direction, from the position of FIG. 4A to the position of FIG. 4B.

Force is transmitted from the piston rod [26] to the upper surface [71] of the ram member [70] by means of four rollers [60]. A pair of rollers [60] are disposed about opposing ends of each roller pin [44], as positioned within the roller angular bore [48] of each bell crank [40], providing "four-point" roller contact on the upper surface [71] of the ram member [70]. The rollers [60] are made by McGill Corp., and are CFH-25 having a two inch diameter. A pair of wear plates [49] are mounted by fasteners [73] onto the upper surface [71] of the ram member [70] to reduce roller wear, one wear plate [49] per a pair of rollers [60]. The wear plates [49] are cold rolled steel and are hardened and ground. The movement of the rollers [60] downward forces the ram member [70] downward toward the lower die head [80]. All four rollers [60] move the same distance during the power stroke outwardly and downwardly, moving away from the piston rod [26] when the piston rod [26] is moving downwardly, and toward the piston rod [26] when the piston rod [26] is moving upwardly. The two pair of rollers [60] are symmetrically balanced as positioned about the upper surface [71] of ram member [70].

The linkage mechanism [30] has a low profile, with a vertical height of up to seven inches, but preferably only about six inches. The capacity of the pneumatic press [10] is from 10 to 50 tons.

The four upright drawbars [68] extend from the press base [90] through the cylinder head [22]. The ram member [70] has corresponding bores [73] disposed at each comer thereof. The ram member [70] slidably receives the four upright drawbars [68] through four bushings [69] disposed at the undersurface [72] of the ram member [70], respectively, enabling movement of the ram member [70] relative to the drawbars [68]. Fastener means [15] secure each drawbar [68] to the cylinder head [22] and fasteners [91] secure each drawbar to the lower die head [80].

The ram member [70] is horizontal throughout the power stroke. The ram member [70] is urged toward the lower die head [80] when the piston rod [26] is extended, and the ram member [70] is withdrawn from the lower die head [80] when the piston rod [26] is retracted.

A pair of die tracks [83 and 84] are provided on the undersurface [72] of the ram member [70], and another pair of dies [85 and 86] are disposed on the upper surface [82] of the base plate or lower die head [80] to secure a die set (not shown) thereto in a conventional manner.

The press base [90] is positioned upon a foundation [92] and secured thereto by fastener means [93] (see FIG. 1).

A pair of horizontal set screws [96] disposed at opposing ends of the support angles [94] secure the support angles [94] to the press base [90]. Also, a pair of fasteners [99] extend through apertures (not shown) in the press base [90] and the support angles [94], and similarly, another pair of fasteners [98] secure the vertical leg of the support angles [94] to the lower die head [80]. Leveling screws [95] are carried by the lower die head [80] for engagement with the press base [90] as illustrated in FIG. 1.

Furthermore, it is evident that many alternatives, modifications, and variations of the pneumatic press [10] of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

What I claim is:

1. A press having a vertically extending longitudinal axis comprising:

a stationary lower die head;

spaced upright guide posts having upper and lower ends mounted upon said stationary lower die head at said lower ends and secured thereto;

an apertured movable upper die head guidably receiving and reciprocally mounted from said guide posts;

said die heads being spaced apart to define therebetween a die set area;

said upper die head having an upper surface and a lower surface;

a top plate secured over the upper ends of said guide posts and spaced above the upper surface of said movable upper die head;

said top plate having upper and lower surfaces, with said last mentioned lower surface being spaced from the upper surface of said movable upper die head to provide a space therebetween;

pivot brackets connected to and depending from said top plate into the space between said top plate and said moveable upper die head;

an opening in said top plate surrounding said longitudinal axis;

a linkage mechanism interposed in the space between said top plate and said movable upper die head;

said linkage mechanism comprising first and second levers having inner and outer ends;

pivot means for connecting the outer ends of said first and second levers respectively to said pivot brackets;

the inner ends of said first and second levers being spaced apart along a transverse axis which is perpendicular to said longitudinal axis;

cam followers mounted on the inner ends of said first and second levers in the space provided between said inner ends;

said first and second levers including intermediate portions engaging the upper surface of said movable upper die head; and a fluid cylinder mounted on said top plate and having a piston rod extending through said opening along said longitudinal axis and engageable with said cam followers;

the energization of said fluid cylinder being effective to extend said piston rod and thereby apply a force to said cam followers and the inner ends of said first and second levers causing said first and second levers to pivot about the pivot means of said pivot brackets thereby vertically moving said movable upper die head as a result of the engagement of said intermediate portions of said first and second levers with said upper die head.

2. The press of claim 1, wherein said cam followers are mounted by mounting pins to the inner ends of said first and second levers.

3. The press of claim 1, wherein each of said intermediate portions is provided with a roller pin, said roller pin having a pair of end portions provided with cylindrical rollers for transmitting the force of said fluid cylinder and said piston rod to said movable upper die head.

4. The press of claim 3, wherein said upper surface of said movable upper die head is provided with a pair of spaced apart wear plates upon which said rollers ride when transmitting the force to effect movement of said moveable upper die head.

5. The press of claim 1, wherein said cylinder rod is provided with an extension having a generally flat surface engageable with said cam followers.

6. The press of claim 1, wherein a press base is provided for mounting the press for limited vertical and horizontal adjustments.

7. The press of claim 1, wherein said fluid cylinder is a pneumatic cylinder.

8. The press of claim 1, wherein opposed spaced upper and lower track members are located in said die set area and secured to said movable upper die head and said stationary lower die head respectively.

9. The press of claim 1, wherein said first and second levers are in the form of bell cranks which are spaced apart, each bell crank being connected by said pivot means to one of said pivot brackets.

10. The press of claim 1, wherein said piston rod has only frictional contact with said cam followers.

* * * * *